US009260967B2

(12) United States Patent
Shi

(10) Patent No.: US 9,260,967 B2
(45) Date of Patent: Feb. 16, 2016

(54) FILAMENTOUS TURBINE

(71) Applicant: Jian Shi, Guizhou (CN)

(72) Inventor: Jian Shi, Guizhou (CN)

( * ) Notice: Subject to any disclaimer, the term of this patent is extended or adjusted under 35 U.S.C. 154(b) by 0 days.

(21) Appl. No.: 14/413,363

(22) PCT Filed: Jun. 14, 2013

(86) PCT No.: PCT/CN2013/077216
§ 371 (c)(1),
(2) Date: Jan. 7, 2015

(87) PCT Pub. No.: WO2014/008800
PCT Pub. Date: Jan. 16, 2014

(65) Prior Publication Data

US 2015/0192018 A1 Jul. 9, 2015

(30) Foreign Application Priority Data

Jul. 13, 2012 (CN) ..... 2012 1 0241691

(51) Int. Cl.
*F01D 1/36* (2006.01)
*F01D 1/34* (2006.01)

(52) U.S. Cl.
CPC .. *F01D 1/36* (2013.01); *F01D 1/34* (2013.01); *F05D 2210/12* (2013.01)

(58) Field of Classification Search
CPC ..... F01D 1/36; F01D 1/34; F05D 2210/12; F04D 5/00; F04D 5/001; F04D 17/16
USPC ..... 415/90; 416/178, 187, 4, 132 R, 240
See application file for complete search history.

(56) References Cited

U.S. PATENT DOCUMENTS

| | | | | | |
|---|---|---|---|---|---|
| 86,320 | A | * | 1/1869 | Reichenbach et al. | 415/141 |
| 1,182,212 | A | * | 5/1916 | Ruchti | 415/24 |
| 1,908,230 | A | * | 5/1933 | Fawkes | 239/222 |
| 2,245,632 | A | * | 6/1941 | Winkler | 366/182.2 |
| 2,998,099 | A | * | 8/1961 | Hollingsworth | 96/283 |
| 3,538,657 | A | * | 11/1970 | Macrow | 96/286 |
| 3,923,416 | A | * | 12/1975 | Frey | 415/76 |
| 2011/0150642 | A1 | * | 6/2011 | Detch | 415/198.1 |

FOREIGN PATENT DOCUMENTS

| | | | |
|---|---|---|---|
| CH | 685 305 | A5 | 5/1995 |
| CN | 201753619 | U | 3/2011 |
| CN | 202851088 | U | 4/2013 |
| KR | 2003-0076476 | | 9/2003 |
| WO | 2008/134868 | A1 | 11/2008 |
| WO | 2011/057019 | A1 | 5/2011 |

OTHER PUBLICATIONS

Abstract of CN 202851088U.
Abstract of CH 685305.
Abstract of KR 20030076476.
Abstract of CN 201753619U.

* cited by examiner

*Primary Examiner* — Christopher Verdier
*Assistant Examiner* — Aaron R Eastman
(74) *Attorney, Agent, or Firm* — Ladas & Parry LLP

(57) ABSTRACT

A kind of filamentous turbine comprises a shell body and a rotor, the shell body is provided with a nozzle, the nozzle is used to eject gas into the shell body, the rotor which is arranged in the shell body comprises a rotor shaft, two fixing disks and a filamentous structure, the two fixing disks are mounted to the rotor shaft, the filamentous structure is mounted between the two fixing disk. The filamentous structure for this kind of filamentous turbine replaces the thin and circular disk of the traditional Tesla turbine, and the filamentous structure provides good integral rigidity and is not easy to deform, so that the rotor can be made larger in diameter, and the filamentous structure facilitates to reduce the machine noise.

3 Claims, 3 Drawing Sheets

FILAMENTOUS TURBINE

RELATED APPLICATION INFORMATION

This application is a 371 of International Application PCT/CN2013/077216 filed 14 Jun. 2013, which was published on 16 Jan. 2014, with International Publication No. WO 2014/008800 A1, which claims priority from Chinese Application No, 201210241691.5 filed on 13 Jul. 2012, the disclosures of which are incorporated in their entirety by reference herein.

TECHNICAL FIELD

The present invention disclosed generally relates to steam turbines, and more particularly to a filamentous turbine.

PRIOR ART

Tesla turbine, also known as non-blade turbine, is usually in a structure having a plurality of smooth and thin discs connected fixedly to a shaft subject to a certain distance, and airflow blows these discs from a tangential direction, the shaft is driven with these discs to rotate by means of boundary layer effect. Once the disc size is larger, for instance, in applications requiring high power output, the Tesla turbine tends easily to deformation for its discs, sizable disturbance of turbulence among the discs and considerable vibration and the like.

SUMMARY OF THE INVENTION

According to one embodiment of the present invention, a filamentous turbine is provided, which includes a shell and a rotor, where the shell is provided with a nozzle, and the nozzle is used to spray air into the shell. The rotor, located in the shell, comprises a rotor shaft, two fixed discs and a filamentous structure, the two fixed discs are connected fixedly to the rotor shaft, and the filamentous structure is fixed between the two fixed discs.

During the working of the filamentous turbine in accordance with the invention, the nozzle sprays air into the shell, and the airflow is formed into turbulence under the guidance of the inner wall of the shell, while the filamentous structure distributed between the two fixed discs plays the role of blades, which substantially increases the contact area for the rotor and the airflow. By means of the boundary layer effect, the rotor will be driven to spin by the airflow to achieve the rotation of the rotor. The filamentous turbine, which replaces the thin discs of the traditional Tesla turbine with the filamentous structure, is featured by great rigidity of the whole and not easy to deformation, which enables the rotor to be fabricated with a greater diameter, to boost the power and to smooth the operation. In addition, the meshes formed by the filamentous structure feature a certain sound attenuation to the airflow out of the nozzle, which helps to reduce machine noises.

The following embodiments of the present invention and the accompanying drawings are combined to offer a thorough comprehension.

DETAILED DESCRIPTION OF THE EMBODIMENTS

Figure 1:
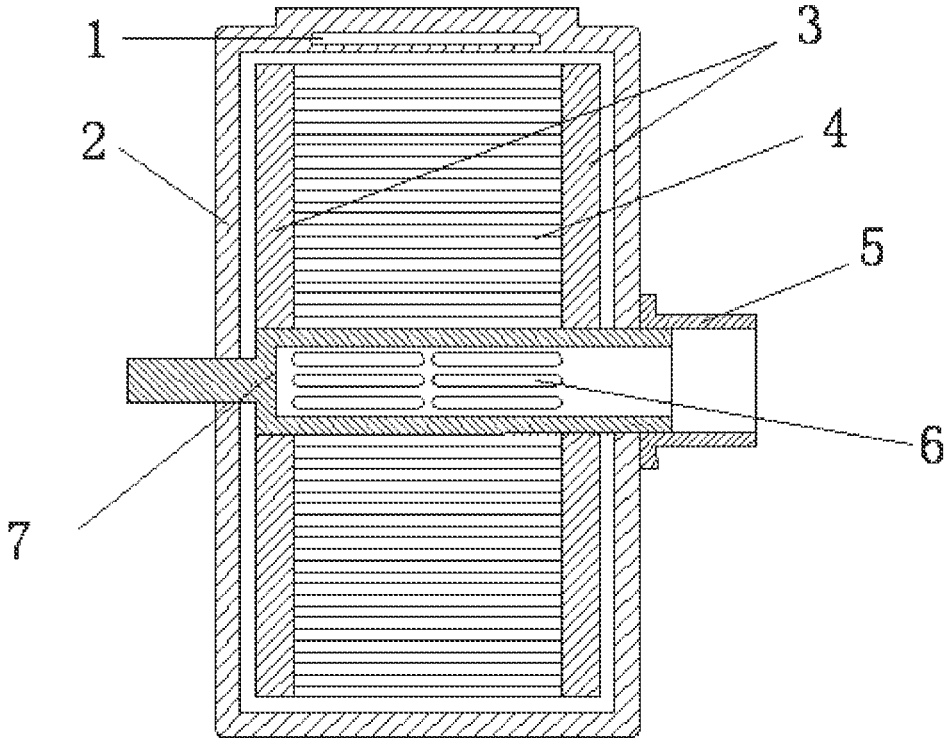
FIG. 1 is an axial sectional view of the filamentous turbine according to an embodiment of the present invention.
Figure 2:
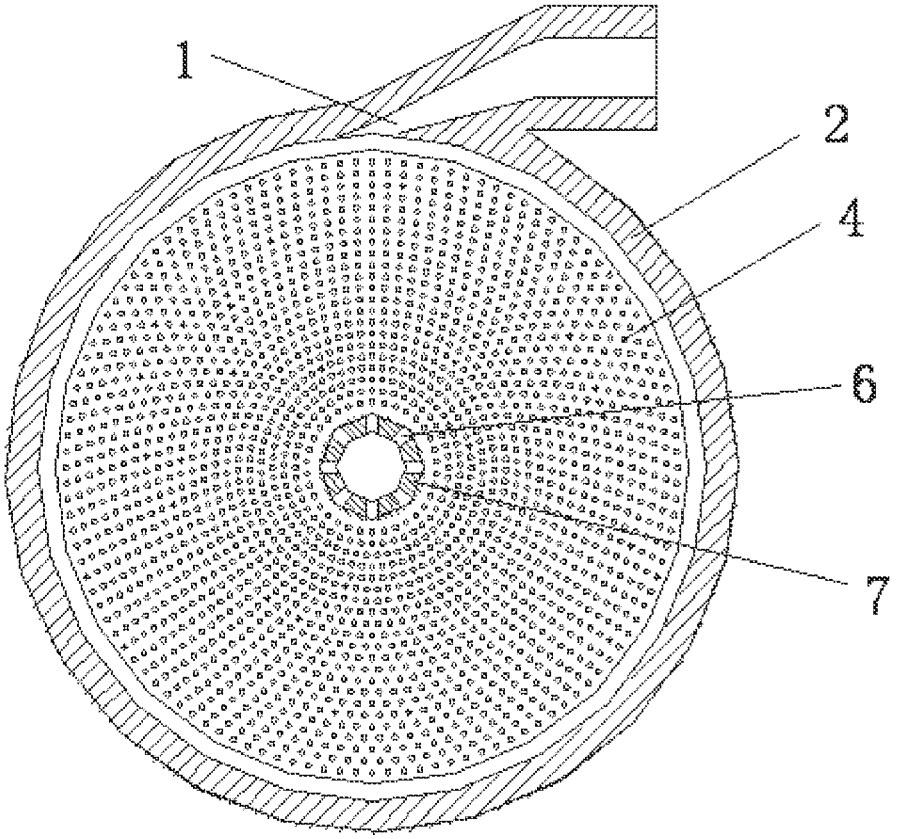
FIG. 2 is a radial sectional view of the filamentous turbine in FIG. 1.

According to a filamentous turbine of one embodiment of the present invention, with reference to FIG. 1 and FIG. 2, where in the figures: 1. nozzle; 2. shell; 3. fixed discs; 4. filamentous structure; 5. vent; 6. vent hole; 7. rotor shaft.

The filamentous turbine of this embodiment comprises a shell 2 and a rotor.

The shell 2 is provided with a nozzle 1, where the nozzle 1 is used to spray gas into the shell 2. To make full use of the energy of the sprayed gas, the shell 2 can be relatively sealed. In this embodiment, the nozzle 1 is disposed along the tangential direction of the inner wall of the shell 2, and its opening is shaped into a long and narrow strip, to fully use the energy of the airflow. In other embodiments, the nozzle may also have the opening in different shapes and angles.

The rotor, located in the shell 2, includes the rotor shaft 7, two fixed discs 3 and the filamentous structures 4.

The rotor shaft 7 is hollow, and its outer surface is provided with vent holes 6, where the vent holes 6 each extends through the hollow of the rotor shaft 7 to join the vent 5. The rotor shaft 7 can be arranged to run through the shell 2, and can rotate relatively to the shell 2.

The two fixed discs 3 are fixed to the rotor shaft 7. To make full use of space, the fixed discs 3 can fully occupy the inner space of the shell 2, for instance, selecting the discs with a diameter slightly shorter than the inner diameter of the shell 2 to be the fixed discs 3. On the other hand, the stiffness of the rotor can be augmented by increasing the thickness of the fixed discs 3, so that the fixed discs are not easy to be deformed when in large size.

The filamentous structure 4 is fixed between two fixed discs 3. Specifically, the filamentous structure 4 can be, for example, metal wire, and is fixed between the two fixed discs 3 by way of, for instance, drilling through, welding, bonding and the like. This embodiment will not limit the substance and fixation of the filamentous structure. To take full advantage of the energy of the sprayed gas by the nozzle 1, the filamentous structure 4 can be placed densely in the rotor space (that is, the space between the two fixed discs 3). In this embodiment, the filamentous structure 4 is vertical to the surface of the fixed discs 3 with a multilayered bird-cage-like shape. In another embodiment, the filamentous structure may also be arranged in a crisscross pattern of three-dimensional network. Yet in other embodiments, the filamentous structure can also take on other styles, as long as it is contained in the rotor space.

During the working of the filamentous turbine, the nozzle 1 sprays the air into the shell 2, and the airflow forms turbulence under the guidance of the inner wall of the shell 2. The filamentous structure 4, abundant between the fixed discs 3, substantially increases the contact area for the rotor and the airflow. By means of the boundary layer effect, the rotor will be driven to spin by the airflow to achieve the rotation of the rotor. The exhaust gas having done the work can be emitted through the vent hole 6 on the rotor shaft 7 and discharged from the vent 5.

Figure 3:
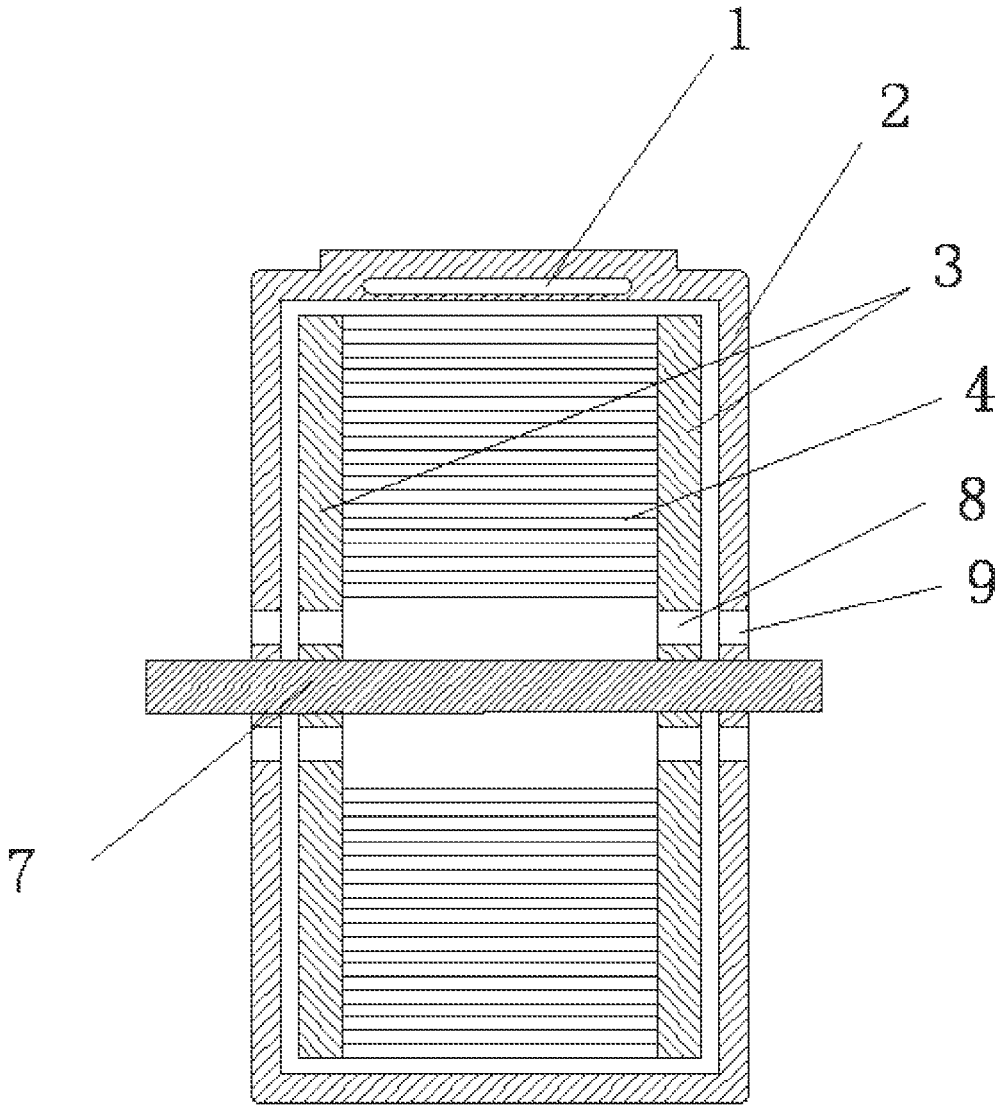
FIG. 3 is an axial sectional view of the filamentous turbine according to another embodiment of the present invention.

According to a filamentous turbine of another embodiment of the present invention, referring to FIG. 3, comparing with the previous embodiment, the difference of the two embodiments lies in that the rotor shaft 7 need not be hollow, and the two fixed discs 3 each is provided with a through hole 8 in the vicinity of the rotor shaft 7 while the shell 2 is also provided with a through hole 9 in the vicinity of the rotor shaft 7.

Therefore, the exhaust gas having done the work can be emitted via the through hole 8 of the fixed discs 3 to leave the rotor space and discharged from the through hole 9 of the shell 2 to outside. Of course, the way of discharging air through the hollowed rotor shaft 7 can have a better seal for the shell, which boosts the energy utilization rate of the gas sprayed by the nozzle and is therefore more preferable.

The forgoing contents were made by combining the embodiments of the present invention for further detail description, which should not be considered that the embodiments of the invention are limited to these descriptions. For those skilled in the art of the present invention, under the premise without departing from the inventive concept, some simple deductions or replacements can be included.

What is claimed is:

1. A filamentous turbine, characterized in that, comprising:

a shell (2), where a nozzle (1) is provided thereon and the nozzle is used to spray gas into said shell;

a rotor (7, 3, 4), said rotor being located in said shell, said rotor comprising:

a rotor shaft (7);

a first disc and a second disc each of said discs (3) being fixed to the rotor shaft; and a filamentous structure (4) comprising a plurality of filaments, each filament having two ends, one of said ends being fixed to said first disc and the other of said ends being fixed to the second disc.

2. The filamentous turbine as recited in claim 1, characterized in that: each filament of the filamentous structure (4) is disposed perpendicular to a surface of the disc (3) to which it is affixed.

3. The filamentous turbine as recited in claim 1, characterized in that: the rotor shaft (7) is hollow and the surface thereof is provided with vent holes (6), where the vent holes extend through the hollow of the rotor shaft to join a vent (5).

* * * * *